US005913778A

United States Patent [19]

Hying et al.

[11] Patent Number: 5,913,778

[45] Date of Patent: Jun. 22, 1999

[54] FLANGED MOUNTING SYSTEM FOR AN IN-GROUND BASKETBALL SYSTEM

[75] Inventors: Clement F. Hying, Menomonee Falls; Ronald A. White, N. Prairie; Randy R. Schickert, Kewaskum, all of Wis.

[73] Assignee: Huffy Corporation, Miamisburg, Ohio

[21] Appl. No.: 08/804,713

[22] Filed: Feb. 21, 1997

[51] Int. Cl.[6] ..... E02D 27/42; A63B 63/08

[52] U.S. Cl. ..... 52/40; 52/170; 52/297; 52/298; 52/704; 52/726.3; 52/736.1; 52/745.18; 248/156; 248/523; 248/530; 473/481

[58] Field of Search ..... 52/40, 170, 297, 52/298, 165, 704, 708, 726.3, 736.1, 745.18, 745.17; 248/156, 523, 530; 285/412, 414; 403/110; 473/481

[56] References Cited

U.S. PATENT DOCUMENTS

| | | |
|---|---|---|
| 1,309,806 | 7/1919 | Medart . |
| 1,409,155 | 3/1922 | Covan . |
| 1,735,722 | 11/1929 | Beard . |
| 3,544,110 | 12/1970 | Dickinson . |
| 3,598,406 | 8/1971 | Robinson . |
| 3,602,505 | 8/1971 | Friend . |
| 3,612,287 | 10/1971 | Maltese . |
| 4,522,394 | 6/1985 | Broussard . |
| 4,896,651 | 1/1990 | Kott, Jr. . |
| 5,112,023 | 5/1992 | Sowers . |
| 5,156,395 | 10/1992 | Smith . |
| 5,211,393 | 5/1993 | Rolffs et al. . |
| 5,337,989 | 8/1994 | Apple . |
| 5,571,229 | 11/1996 | Fitzsimmons et al. . |

OTHER PUBLICATIONS

Goalrilla Basketball Systems, Zue Corp., 1994, 4 pgs.
Schutt Sports Group, Slam Series, 1995, 2 pgs.
Porter Athletic Equipment Company, Big Shot Kits, admitted prior art, 5 pgs.
Lifetime Products, Accessory Ground Sleeve, Model No. 0023, admitted prior art, 2 pgs.
Bison Recreational Products, Retail Basketball Poles, see especially, BA709, admitted prior art, 1 pg.
Bison Recreational Products, Product Brochure, admitted prior art, 4 pgs.

*Primary Examiner*—Christopher Kent
*Attorney, Agent, or Firm*—Howrey & Simon; Michael J. Bell; Erik B. Milch

[57] ABSTRACT

A basketball mounting system for an in-ground basketball system has a flanged basketball support pole and a flanged ground sleeve receiving a portion of the pole in overlapping relationship. The flanges are connected together by removable fasteners such as threaded bolts. In addition, the mounting system may include jacking members in the pole flange to facilitate removal of the pole from the ground sleeve. The jacking members include members such as threaded bolts passing through the pole flange that, when rotated in one direction, press against the ground sleeve flange causing the pole and the ground sleeve to separate.

40 Claims, 13 Drawing Sheets

FLANGED MOUNTING SYSTEM FOR AN IN-GROUND BASKETBALL SYSTEM

BACKGROUND OF THE INVENTION

1. Field of the Invention

The invention relates generally to a mounting system for an in-ground basketball system and, more particularly, to a flanged ground sleeve that receives in overlapping relationship an end of a flanged pole, and which may incorporate a mechanical device to facilitate removal of the pole from the ground sleeve.

2. Related Art

In-ground basketball systems are usually permanently mounted in the ground adjacent a playing surface, such as a driveway. Traditionally, a basketball system includes a pole supporting a backboard and a goal. To rigidly support the basketball system in a upright position, in the past, a hole was formed in the ground, filled with concrete and one end of the pole, was sunk directly in the concrete and the concrete was allowed to set. Then, the backboard and goal would be assembled on the top end of the pole. Once the concrete has set, the pole is essentially permanently mounted and, effectively, cannot be removed short of digging up the ground and breaking the concrete slug off of the end of the pole.

However, it may be desirable or necessary to remove the pole from the ground after installation for purposes of maintenance, convenience, storage, relocation and/or security. Removability is particularly important for heavy duty and/or high performance basketball systems because consumers are more likely to want to move these more expensive systems.

One approach that has been used to provide basketball pole removability is known as an anchor bolt style footing. In one such known footing, the anchor includes a stem with a flat square plate including bolt openings disposed on one end of the stem. The stem is set in the concrete so that the flat plate provides a flat mounting surface for a pole of the type having a square flat plate at its lowermost end. The pole flat plate has bolt openings alignable with the bolt openings in the anchor. The pole plate is aligned on the anchor plate; and nuts and bolts are used to secure the two flat plates together. This manner of mounting a basketball pole, however, is difficult because it: is susceptible to tipping over if the bolts break or the nuts are loosened/removed; and is difficult, if not impossible, to remove the pole once the bolts, nuts and flange seize over time due to corrosion and exposure to the elements.

Another approach that has been used to removably mount an in-ground basketball system is through the use of a ground sleeve. A ground sleeve is generally an elongated tubular member having an open end and a closed end, which is often in the form of a cap or cover. During installation, the ground sleeve is positioned in the fresh concrete with the open end exposed to receive the end of a conventional basketball pole that would otherwise have been sunk directly in the concrete. The pole is received in the open end of the ground sleeve. The size of the ground sleeve is usually somewhat larger than the size of the pole to accommodate manufacturing tolerances and variations in size, and to facilitate assembly on location. Accordingly, once the pole is disposed in the ground sleeve, it is loose and the pole must be secured fixedly in the ground sleeve so that the pole will not tilt or rotate.

In one known ground sleeve, a locking tab is used to secure the pole and ground sleeve together. The locking tab is inserted in the gap between the pole and the ground sleeve and a bolt is threaded through the tab perpendicular to the tab and the pole. When the bolt is tightened, the end of the bolt presses against the side of the pole causing the pole to be tightened in the ground sleeve. However, the gap between the pole and the ground sleeve remains open at the open end of the ground sleeve allowing rain and debris to enter and collect between the inside of the ground sleeve and the pole. Over time, this exposure to the weather may cause the pole and ground sleeve to corrode and seize making pole removal difficult if not impossible.

A better way of securing a ground sleeve and pole together is disclosed in U.S. Pat. No. 5,571,229 to Fitzsimmons et al., assigned to the assignee of this application. Fitzsimmons et al. '229 discloses a ground sleeve having a deformable end that is secured to the pole by screwing a cap on the deformable end of the ground sleeve to form a collet having an adjustable opening for engaging the pole. The ground sleeve and cap are formed of a corrosion resistant material and the cap helps protect the ground sleeve and the end of the pole from the elements, thereby facilitating removal of the pole even after a long passage of time.

Another known ground sleeve mounting system includes a flat square flange plate covering its open end to form a flat mounting surface. The basketball pole has another flat square flange plate covering its outermost end. The flanges are approximately 12 inches by 12 inches. During installation, the pole plate is disposed on the ground sleeve plate and the plates are clamped together by nuts and bolts. This construction is susceptible to tipping over during installation, or if the bolts break or the nuts are loosened/removed. Moreover, due to exposure to the elements, the bolts, nuts and flanges may corrode and attach together making removal of the pole difficult if not impossible.

Mounting systems for supporting a pole in the ground in non-basketball environments often are overly complicated or cumbersome, are not designed to facilitate removal, and often require the use of an intermediate sleeve. One type of pole stand is disclosed in U.S. Pat. No. 5,337,989 to Apple. The Apple '989 patent discloses a cylindrical two-piece pole stand assembly where two internal pivots arms are engaged upon insertion of the pole to lock the two pieces together. In particular, a tubular insert is disposed in a ground sleeve until a collar on the tubular insert comes to rest on a collar on the ground sleeve. The insertion of a pole (not shown) into the tubular insert causes pivot arms on the interior of tubular insert to engage the collar on ground sleeve, thereby locking the tubular insert and ground sleeve together. This device requires not only the use of a tubular sleeve in addition to the pole, but also requires the pole to lock the tubular sleeve to the ground sleeve. Although not shown, the pole would finally come to rest on the bottom of the ground sleeve. Moreover, the ground sleeve has a drainage hole which exposes the interior of the sleeve and the pole to the elements.

In U.S. Pat. No. 3,612,287 to Maltese, a tubular upright support member for floor display fixtures is inserted into a tapered floor plug through the use of a tapered tubular adapter. To vary the height of the support member, a locknut is variably positioned on a threaded end of the support member. Then, the threaded end of the support member is threaded into the adapter, and the tapered end of the adapter is wedged into the floor plug. The support member and the adapter are not otherwise secured into the floor plug. Similar, to Apple '989, the Maltese '287 pole mounting system requires the use of an intermediate member to mount the pole. Moreover, because the adapter frictionally engages the floor plug, removal is difficult, especially if other shaped members are used such as square.

The foregoing discussion shows there is a need for an improved ground sleeve for basketball systems that is capable of supporting even the most heavy duty of in-ground basketball systems in a substantially upright rigid and stable position without the risk of tipping, yet also can be readily removed even if the pole and the ground sleeve have seized due to exposure to the elements and/or corrosion. Moreover, a simple interconnection between the pole and ground that eliminates the need for intermediate connecting members also is needed.

SUMMARY OF THE INVENTION

The invention meets these needs and avoids the drawbacks and disadvantages of the prior art by providing a mounting system for supporting an in-ground basketball system including a flanged ground sleeve used in combination with a flanged pole in which a portion of the basketball support pole and the ground sleeve overlap to prevent the pole from tipping over when unsecured.

In one particularly advantageous embodiment of the invention, this is accomplished by having the pole flange, which is disposed intermediate but near one of the pole ends, and the ground sleeve flange each extend outwardly from the longitudinal axis of the support system. One end of the pole is received within the open end of the ground sleeve until the flanges come into contact and the pole cannot be inserted any further, thereby creating an overlap between the pole and ground sleeve. Removable connectors couple the ground sleeve flange and the pole flange together outside of the basketball pole. The connectors may be in the form of weld nuts and bolts associated with the pole and ground sleeve flanges. In practice, an overlap between the pole and ground sleeve on the order of about five inches is sufficient to hold the system in place without having to rely upon the function of any of the bolts.

In another embodiment of the invention, the pole flange may have a portion that is curved or tapered relative to the longitudinal axis of the basketball support pole. This feature improves the strength of the flange. In addition, the ground sleeve flange may be formed to have a shape corresponding to the ground sleeve flange to assist with positioning and alignment of the pole flange and the pole in the ground sleeve.

According to another aspect of the invention, the in-ground basketball support system may include one or more jacking members forming a release system facilitating the removal of the pole from the ground sleeve. The jacking member may be in the form of a bolt threaded through only one of the flanges, preferably the pole flange. In one embodiment, two jacking members are disposed on opposing sides of the pole. In operation, any mechanical connectors used to connect the pole to the ground sleeve during installation are removed. Then, the jacking bolt is rotated in one direction until the pole and the ground sleeve separate so that the pole can be removed entirely from the ground sleeve.

The overlapping pole and ground sleeve design of the invention in conjunction with the flanged connection provides a stronger interface with less flange area required than typically was the case in prior ground sleeve support systems. The overlapping design is an inherent safety feature that eliminates or significantly reduces the likelihood of a system falling over and causing damage, especially during installation, maintenance or pole removal. The release system of the invention provides a mechanical assist for separating the pole that heretofore has not been commercially available in prior basketball support systems.

Other features and advantages of the invention will be apparent from the following description, the accompanying drawings and the appended claims.

DETAILED DESCRIPTION OF PREFERRED EMBODIMENTS

Figure 1:
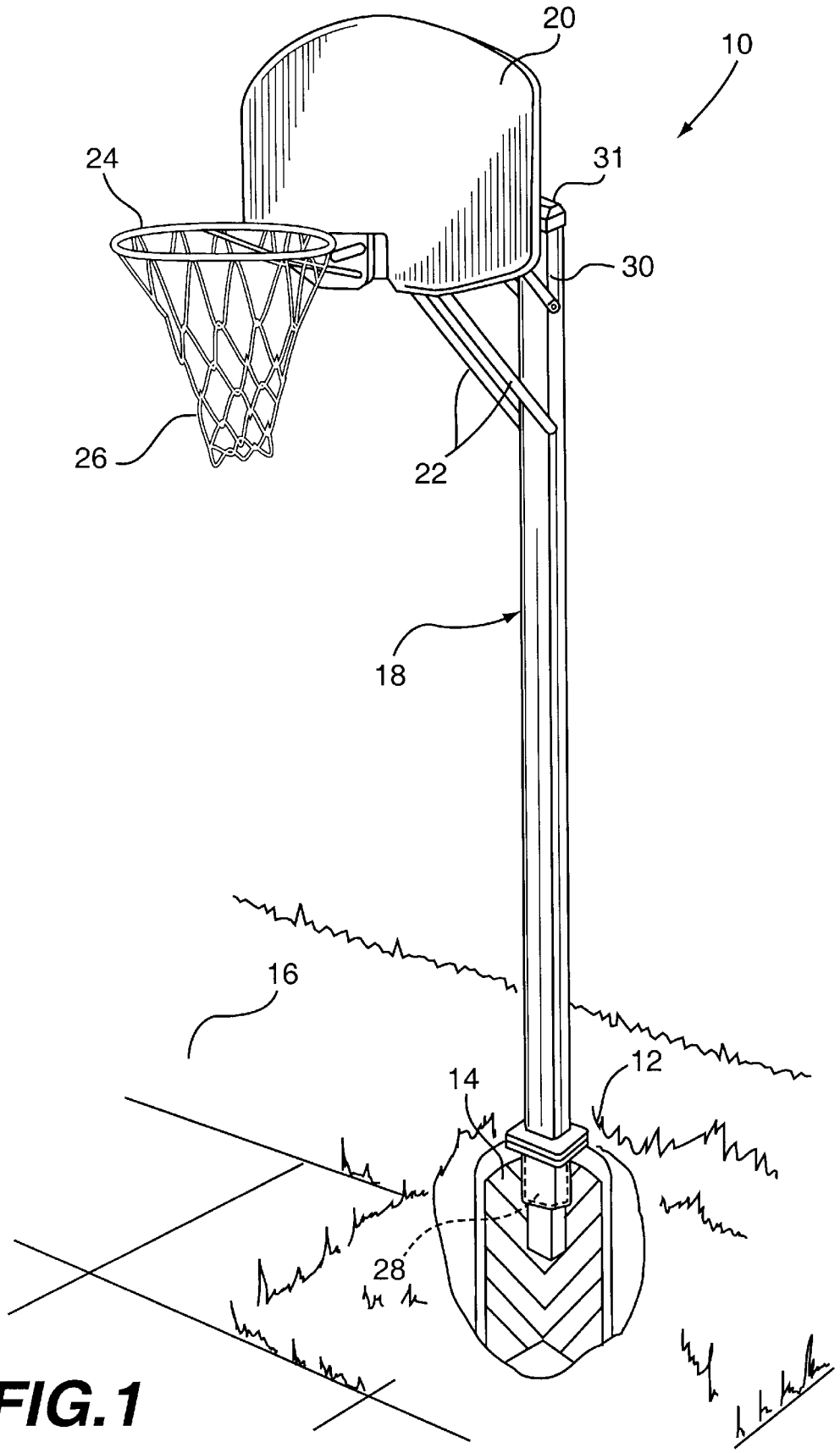
FIG. 1 is a partially cut-away, perspective view of a basketball system supported in the ground with a first embodiment of a basketball pole mounting system constructed in accordance with the principles of the invention.

Referring to FIG. 1, an in-ground basketball system of the invention is shown generally at 10. In-ground basketball system 10 generally includes a ground sleeve 12, a basketball support pole 18, a backboard 20 and a goal 24. In particular, ground sleeve 12 is substantially encased in concrete 14 filled in a hole in ground 16. Pole 18 has a bottom end 28 removably secured, in accordance with the invention, in ground sleeve 12 and a top end 30 supporting backboard 20 by way of support arms 22. Goal 24 is mounted on a front face of backboard 20 supported on pole 18 in a conventional manner. As shown, goal 24 has a net 26 hanging therefrom.

Figure 2:
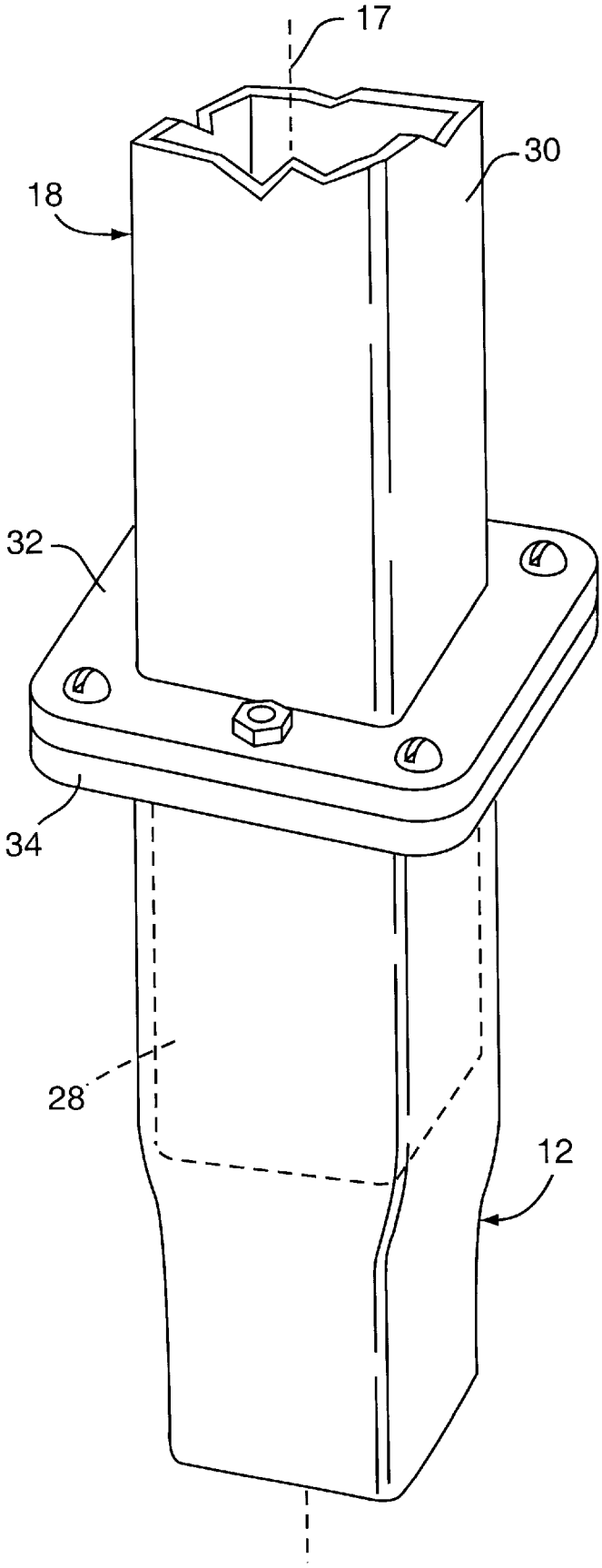
FIG. 2 is an enlarged perspective view of the basketball pole mounting system shown in FIG. 1, illustrating the connection of flanges provided on the ground sleeve and on the bottom portion of the basketball pole.
Figure 3:
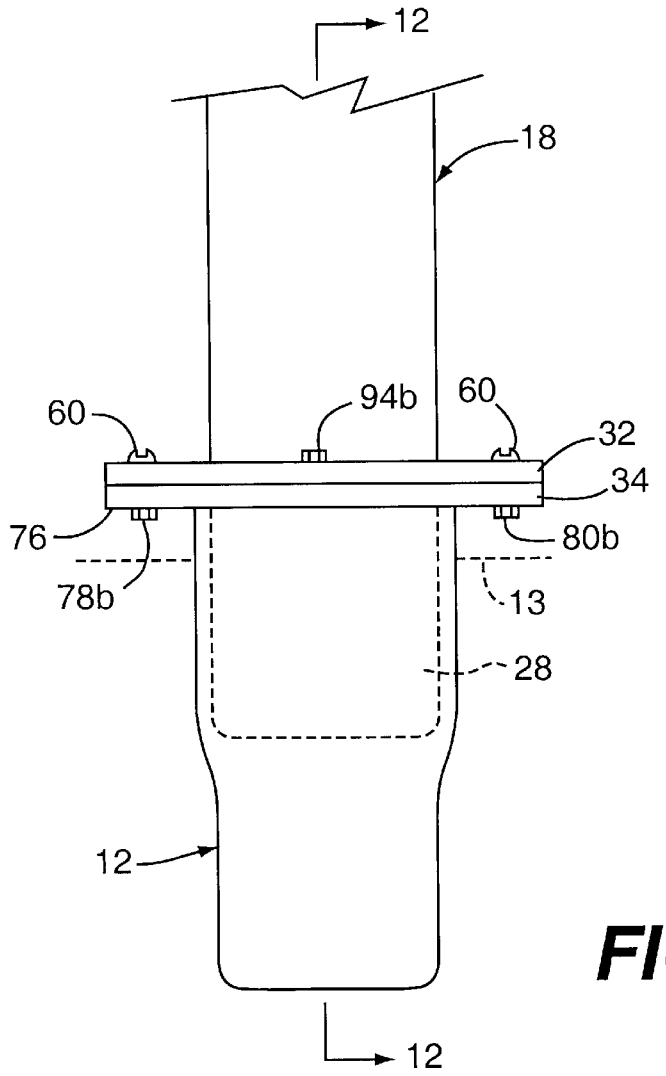
FIG. 3 is a side elevational view of the basketball pole mounting system shown in FIG. 2.
Figure 4:
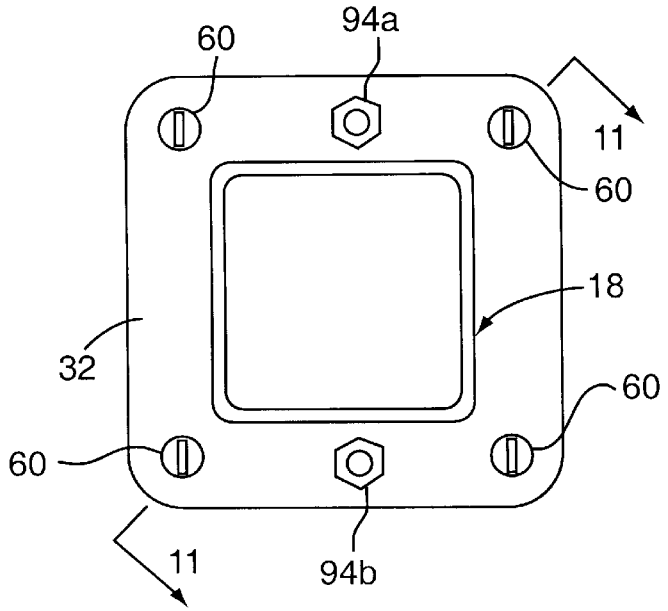
FIG. 4 is a top view of the basketball pole mounting system shown in FIG. 2.

Referring now to FIGS. 2–4, an enlarged overview of a basketball pole mounting system constructed in accordance with the principles of the invention will be discussed. Pole 18 is removably secured in ground sleeve 12 along a longitudinal axis 17 of the support system in a manner discussed below such that longitudinal axis is substantially upright. Generally, pole 18 has a peripheral flange 32 extending outwardly from pole 18 intermediate bottom end 28 and top end 30. It is preferred that flange 32 be much closer to bottom end 28 than top end 30. Ground sleeve 12 has a peripheral flange 34 extending outwardly from an open end 63 of ground sleeve 12 (shown best in FIG. 10). Bottom end 28 of pole 18 is received within ground sleeve 12 in overlapping relationship and flanges 32, 34 are connected to secure pole 18 and ground sleeve 12 together.

Ground sleeve 12 is disposed in concrete such that flange 34 is disposed above top surface 13 of concrete 14 as shown in FIG. 3, with a spacing of approximately 1 inch above the top surface being preferred. However, flange 34 need only be disposed slightly above top surface 13 of concrete 14 so long as concrete 14 does not interfere with the mechanical connection of flange 32 to flange 34. For example, it is desirable that concrete 14 does not contact weld nuts 78*b*, 80*b*, 82*b* and 84*b* provided on lower surface 76 of ground sleeve flange 34, which are described subsequently. Upon installation of pole 18 into ground sleeve 12, bottom end 28 is received in the ground sleeve 12 until flange 32 contacts flange 34. Then, flange 32 is secured to flange 34 as described in detail in the following discussion.

Figure 5:
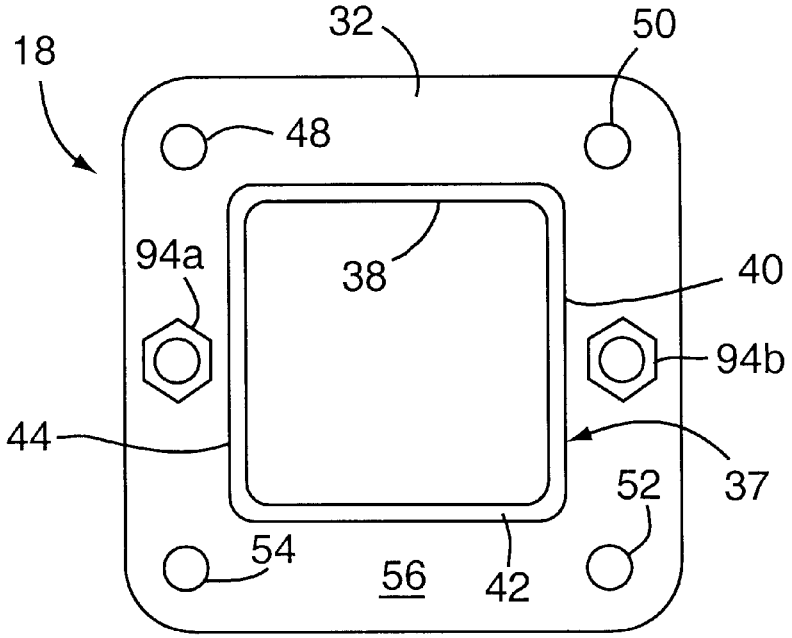
FIG. 5 is a top view of the bottom portion of the basketball pole shown in FIG. 2.
Figure 6:
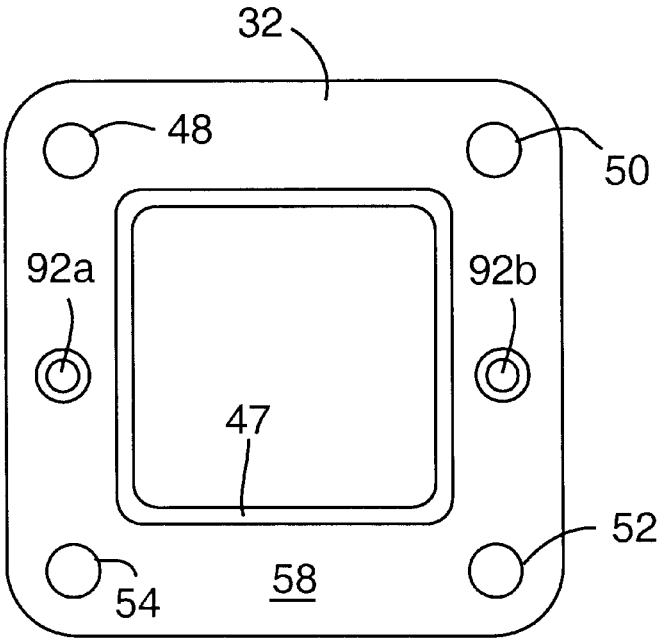
FIG. 6 is a bottom view of the bottom portion of the basketball pole shown in FIG. 2.
Figure 7:
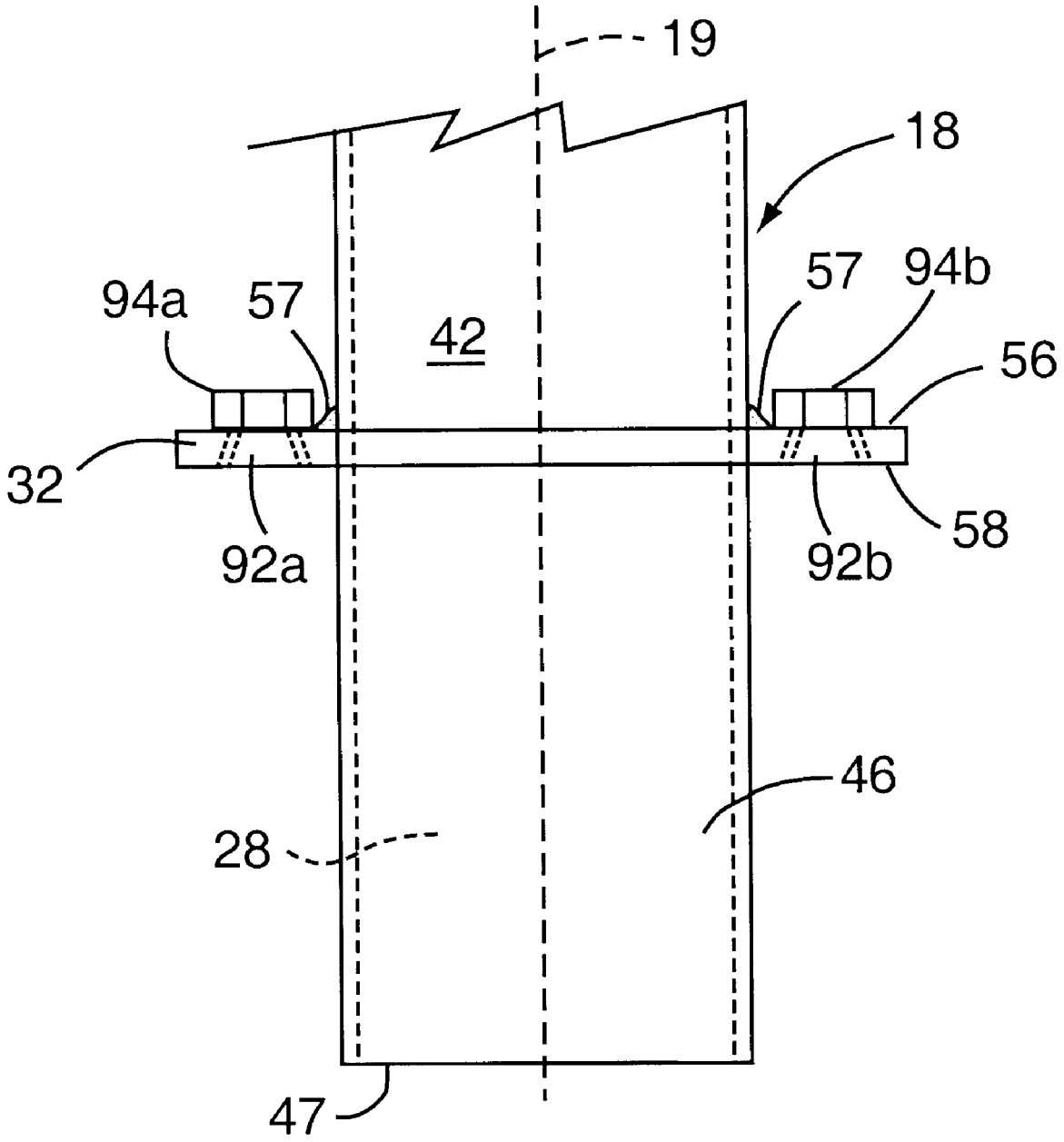
FIG. 7 is a side elevational view of the bottom portion of the basketball pole shown in FIG. 2.

The details of one embodiment of basketball support pole 18 will now be discussed with reference to FIGS. 5–7. Pole 18 preferably is a hollow elongated member having a thin peripheral wall 37 formed by four sides 38, 40, 42 and 44 interconnected by four generally rounded comers. Wall 37 preferably is formed from a rigid material such as metal, for example, 11 gauge steel with a thickness of approximately 0.12 inches. In transverse cross-section, pole 18 has a generally square shape with a 4 inch exterior length and a 4 inch exterior width. Pole 18 has a length of a standard in-ground basketball pole, for example, approximately 141.25 inches in total length. Pole 18 may include pole sections, in particular, two 54 inch pole sections and one 34.625 inch pole section; or, for purposes of compact shipping, may include three substantially equal length pole sections each having a 47 inch length. Bottom end 28 and top end 30 of pole 18 preferably are open as illustrated in the top and bottom views of pole 18 shown in FIGS. 5 and 6. Top end 30 may be closed by a pole cap 31 as shown in FIG. 1. Other pole shapes, sizes and constructions may be employed without departing from the principles of the invention as will be recognized by the skilled artisan.

Pole flange 32 may be formed from a flat annular ring having an upper surface 56 and lower surface 58 with a central opening therein and through which pole 18 is disposed. Flange 32 is fixedly secured to the outer periphery of pole 18 by welding, for example. Preferably, the weld is made on an upper surface 56 of flange 32 as illustrated in FIG. 7 at 57, so as to not interfere with the interface between flange 32 and flange 34. Flange 32 extends outwardly from pole 18 in a direction substantially perpendicular to longitudinal axis 19 of pole 18, although other orientations may be employed. Flange 32 is disposed on pole 18 preferably about 5.25 inches inwardly from the outermost portion 47 of bottom end 28 so as to define approximately a 5.25 inch pole section 46 that is received in overlapping relationship with ground sleeve 12 for purposes discussed in detail later. The exact placement of flange 32 along pole 18 and thereby the length of the pole overlap section 46 may vary so long as the length received within ground sleeve 12 is sufficiently long to prevent pole 18 from tipping over, and to adequately limit vibration and movement of pole 18 during play.

An outer periphery of pole flange 32 defines a substantially square shape with rounded comers corresponding to the square shape of pole 18. If the outer length and width of flange 32 is approximately 7 inches, flange 32 extends a distance of approximately 1.5 inches outwardly from the outer peripheral wall 37 of a 4 inch square pole 18. The thickness of the flange 32 between upper and lower surfaces 56, 58 may be preferably approximately 0.38 inches. Because the invention includes pole overlap section 46, the size of flange 32 may be reduced without sacrificing stability as discussed in greater detail later. However, the precise size, shape and thickness of flange 32 may be varied so long as the flange is sufficiently strong to bear the load of basketball system 10 without causing flanges 32 and 34 to fail, such as by bending, during steady state installation, play, inclement weather and removal. For example, when larger backboards are used or when ground sleeve 12 and pole 18 must support an unusually large amount of weight, then flanges 32 and 34 may be enlarged in size and/or thickness in a manner readily apparent to the skilled artisan.

Pole flange 32 is adapted to be connected to flange 34 of ground sleeve 12. In particular, as shown in FIGS. 5–6, each of the four corners of flange 32 has a clearance hole 48, 50, 52 and 54 passing there through, preferably 0.5 in diameter. As discussed in detail later, a threaded bolt 60 (FIG. 12) is passed through each of clearance holes 48, 50, 52 and 54, respectively, and then into corresponding clearance holes (discussed with reference to FIGS. 8–10) provided in flange 34 of ground sleeve 12. Nuts may be welded to the under side of ground sleeve flange 34 to receive the bolt 60 for fixedly, but removably securing pole 18 in ground sleeve 12. The size of clearance openings 48, 50, 52 and 54 may be varied from 0.5 inches so long as they are of a size sufficient to receive a bolt that is strong enough to withstand shearing and failure under the load of basketball system 10. In the alternative, the grade of bolt 60 may be increased. In accordance with this particular embodiment of the invention, a grade no. 2 bolt is used.

Figure 8:
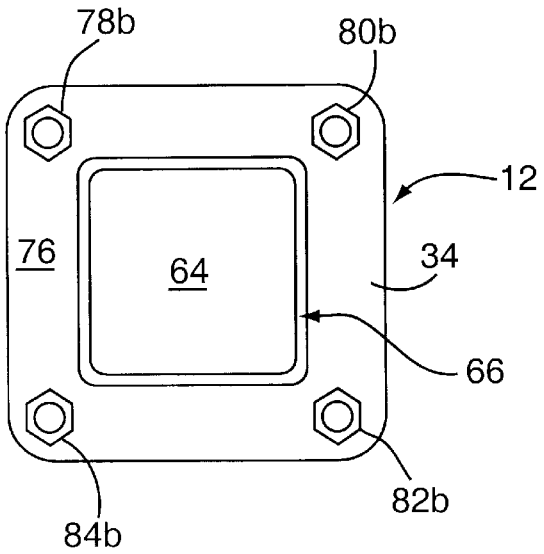
FIG. 8 is a bottom view of the ground sleeve shown in FIG. 2.
Figure 9:
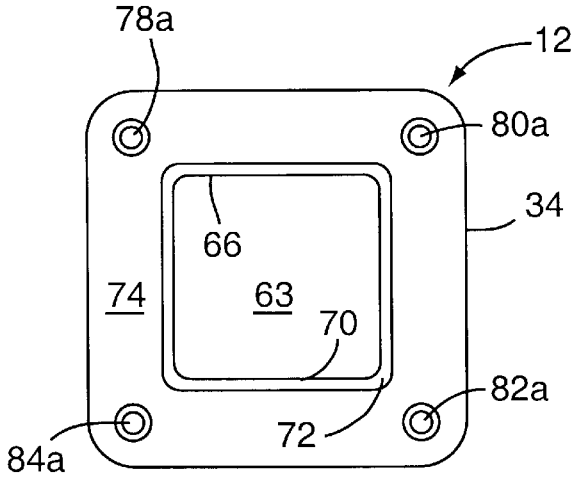
FIG. 9 is a top view of the ground sleeve shown in FIG. 2.
Figure 10:
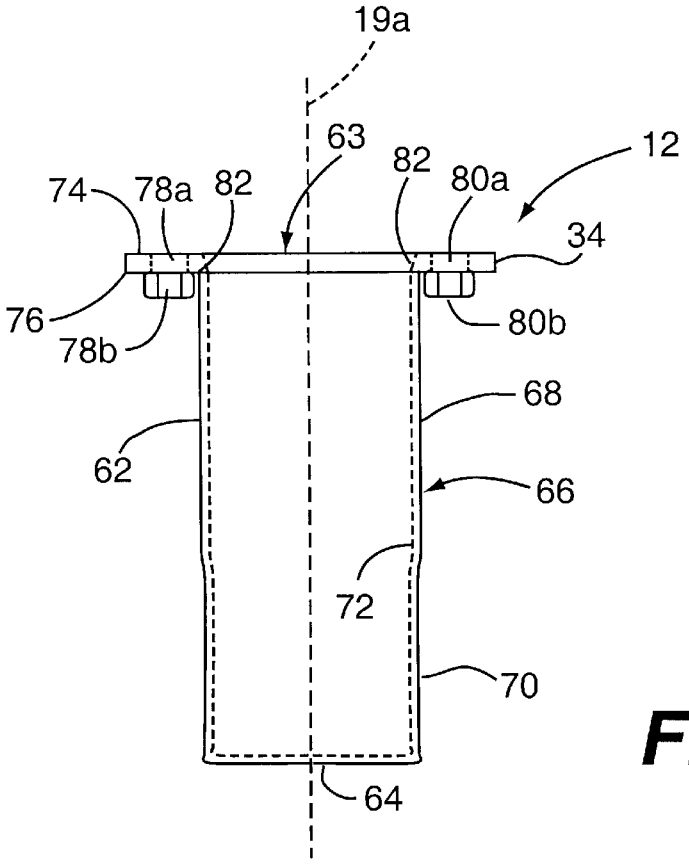
FIG. 10 is a side elevational view of the ground sleeve shown in FIG. 2.

Referring now to FIGS. 8–10, the details of one embodiment of ground sleeve 12 will be discussed. Ground sleeve 12 includes a main body 66 having an open end 63 and an opposed, closed end 64 for receiving a bottom portion of pole 18. Similar to pole flange 32, ground sleeve flange 34 is in the form of a flat annular ring having upper and lower surfaces 74, 76 with a central opening through which open end 63 of main body 66 is disposed. Flange 34 is fixedly secured to main body 66 adjacent open end 63 by, for example, welding. Preferably, the weld is provided on lower surface 76 of flange 34 such that the weld does not interfere with the interface between flanges 32 and 34.

Flange 34 extends outwardly from main body 66 in a manner substantially perpendicular to a longitudinal axis 19a of ground sleeve 34, which should be coincident with longitudinal axis 19 of pole 18 to define a longitudinal axis 17 of the mounting system when installed within ground sleeve 12. Main body 66 is a hollow member formed by a wall 62 of a rigid material such as metal, for example, 11 gauge steel, having a thickness of approximately 0.12 inches and length of approximately 17 inches. These dimensions offer adequate stability and anchoring for the basketball system 10, however, ground sleeve 12 may be formed of other thicknesses or lengths depending upon the particular design employed. Main body 66 has a substantially square transverse cross-sectional shape to match the shape of pole 18, but other shapes for both the ground sleeve and pole may be employed as will be recognized by the skilled artisan.

Figure 11:
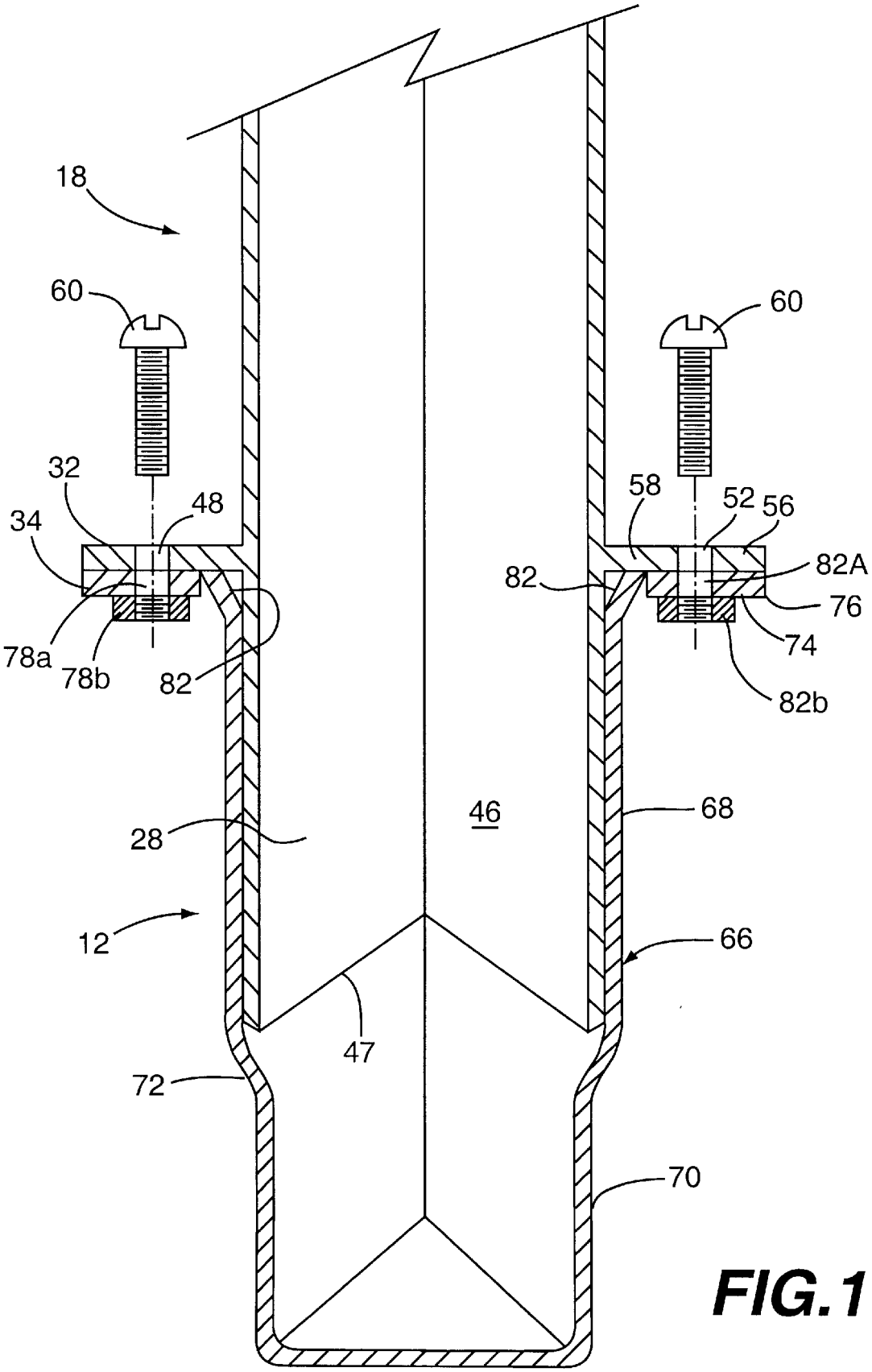
FIG. 11 is a cross-sectional view of the basketball pole mounting system taken along line 11—11 in FIG. 4.

Closed end 64 at the lower end of ground sleeve 12 is disposed in concrete 14 and open end 63 at the upper end of ground sleeve 12 receives pole 18. Main body 66, as shown, is integrally formed with closed end 64, however, in the alternative, the lower end may be formed with an open end closed by a cap. The configuration of ground sleeve 12 varies along its longitudinal axis 19a. In particular, main body 66 has a first portion 68 that has an expanded size in transverse cross-section and a second portion 70, which is slightly narrower in transverse cross-section than first portion 68. First portion 68 is configured to receive pole overlap section 46 therein. A small shoulder or ledge 72 is formed between the first and second portions 68, 70. First portion 68 has a shape corresponding to the shape of pole 18 and interior dimensions slightly larger than the exterior dimensions of pole overlap 46 of pole 18. For example, first portion 68 may have an interior transverse cross-sectional length and width of about 4.030×4.030 inches and a longitudinal length ofjust over about 5.25 inches. This interior size should provide for a loose fit or a slip fit between the exterior surface of pole 18 and the interior surface of first portion 68 of ground sleeve 12. Preferably, this fit is not an interference fit to facilitate removability. First portion 68 may be formed with a larger interior dimension. However, enlarging the transverse size of the interior of first portion 68, and thereby creating a significant gap between pole 18 and ground sleeve 12, may sacrifice stability of the support system and possibly introduce vibration and movement into the system. First portion 68 may also include a tapered portion 82 at open end 63 that is slightly larger than first portion 68 and which tapers inwardly to the size of first portion 68. This tapered portion 82 facilitates insertion of bottom end 28 of pole 18 into ground sleeve 12. Tapered portion 82 is also illustrated in FIG. 11.

Second portion 70 of main body 66 extends from first portion 68 to closed end 64, and preferably has a transverse length and width slightly smaller than the transverse length and width of first portion 68. For example, second portion 70 may have the same transverse size and shape as pole 18 and a longitudinal length of approximately 11.75 inches. As second portion 70 is slightly smaller than first portion 68, the transition area between first portion 66 and second portion 70 forms the small shoulder or ledge 72 on the interior of main body 66. Preferably, the end of pole overlap section 46 ends just before ledge 72 such that flanges 32 and 34 define the point of contact upon insertion of pole 18 into ground sleeve 12, i.e. the bottom of pole 18 will not contact the ledge 72.

In accordance with another aspect of the invention, tubular members with the same transverse cross-sectional dimensions can be used to produce both pole 18 and ground sleeve 12. Thus, to form ground sleeve 12, one end of this tubular member is expanded in any conventional manner known in the metal working art to form first portion 68 and second portion 70 remains unaltered with the same transverse size as pole 18. In the alternative, ground sleeve 12 need not have a variation in its transverse size along longitudinal axis 19*a* and may have a constant transverse interior dimension for its entire length, which would be the transverse interior size of first portion 68.

Flange 34 has a shape and size corresponding to the shape and size of flange 32 on pole 18. Upper surface 74 of flange 34 is adapted to contact lower surface 58 of flange 32 and lower surface 76 of flange 34 is adapted to be positioned in the vicinity of top surface 13 of concrete 14 or ground 16. The thickness of ground sleeve flange 34 may be approximately 0.375 inches. Flange 32 includes at each of its four comers a clearance hole 78*a*, 80*a*, 82*a*, and 84*a*, each of which has about a 0.72 inch diameter to receive four 0.5 inch diameter opening nuts 78*b*, 80*b*, 82*b*, and 84*b* preferably welded to lower surface 76 of flange 32. Thus, weld nuts 78*b*, 80*b*, 82*b* and 84*b* define about 0.5 inch diameter openings each for receiving bolt 60.

The invention enables the size, width, and especially the length of flanges 32 and 34 to be reduced without sacrificing stability compared with the dimensions that would be required if pole overlap section 46 was not provided. For example, with the invention, 7 inch square pole and ground sleeve flanges can adequately support at least a basketball system with a 54 inch backboard and a 1,500 pound hang weight, which is measured off goal 24. However, other dimensions may be employed as will be recognized by the skilled artisan. For example, an enlarged flange may be provided, typically, in the range of approximately 7–10 inches when a heavier or larger basketball system is to be supported. In particular, 10 inch square flanges may be used to support a basketball system with a 72 inch backboard and a 6 inch pole.

Referring now to FIG. 11, a cross-sectional view taken along line 11—11 in FIG. 4 will now be discussed. As shown, bottom end 28 of pole 18 is guided into ground sleeve 12 via tapered opening 82 until lower surface 58 of flange 32 abuts upper surface 74 of flange 34. Accordingly, pole overlap section 46 is completely disposed in ground sleeve 12. As shown, pole overlap section 46 loosely fits into first portion 68 such that the outer periphery of pole overlap section 46 is adjacent the inner periphery of first portion 68 of ground sleeve 12. As discussed earlier, this loose fit facilitates removal of pole 18 from ground sleeve 12 without sacrificing stability. Bolts 60 are of the type having a head and a threaded shaft. The threaded shaft of bolt 60 is passed through, respectively, clearance openings 48, 50, 52, and 54 in flange 32, then through clearance openings 78*a*, 80*a*, 82*a*, and 84*a* in flange 34, and finally, are threaded into weld nuts 78*b*, 80*b*, 82*b*, and 84*b* provided on lower surface 76 of flange 34 until flanges 32 and 34 are secured together.

Figure 12:
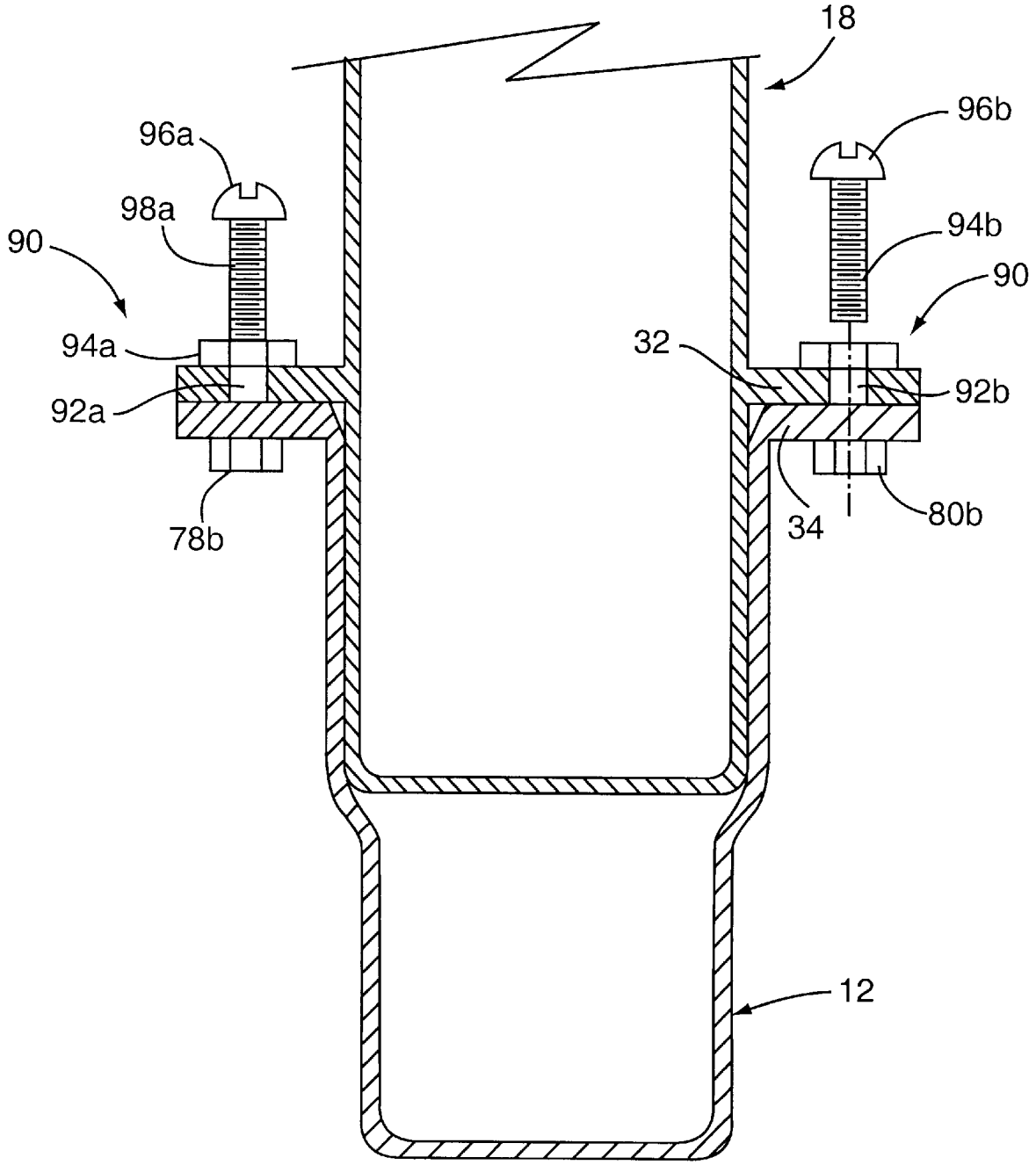
FIG. 12 is a cross-sectional view of the basketball pole mounting system taken along line 12—12 in FIG. 3 illustrating jacking devices constructed in accordance with the principles of invention.

Referring now to FIG. 12, in combination with FIGS. 5, 6, 8 and 9, jacking devices shown generally at 90 will be discussed. In particular, to remove pole 18 from ground sleeve 12, bolts 60 must be removed and pole 18 must be withdrawn along longitudinal axis 19 until pole overlap section 46 is outside of ground sleeve 12. Generally, ground sleeve 12 is left behind. However, over time, the interface between pole 18 and ground sleeve 12, in particular, pole flange 32 and ground sleeve flange 34, may attach or become fixed to each other under the pressure of basketball system 10 weighing down on pole 18 in ground sleeve 12 and/or due to corrosion or exposure to the elements. If this occurs, pole 18 cannot easily be removed from ground sleeve 12 by a consumer. To overcome this problem, jacking devices 90 in accordance with the invention can force pole 18 to move longitudinally away from ground sleeve 12 and separate these parts.

In particular, jacking devices 90 include a pair of clearance openings 92*a* and 92*b*, preferably about 0.72 inch in diameter, passing through pole flange 32 for receiving weld nuts 94*a* and 94*b*, preferably about 0.5 inches in diameter, disposed on upper surface 56 of pole flange 32 in alignment with clearance openings 92*a* and 92*b*. Clearance openings 92*a* and 92*b* and weld nuts 94*a* and 94*b* are preferably centrally disposed on opposing sides of pole 18 to distribute their force equally across the interface between pole 18 and ground sleeve 12. Ground sleeve flange 34 remains unaltered and upper surface 74 of ground sleeve flange 34 abuts lower surface 58 of pole flange 32 to cover openings 92*a* and 92*b*. A pair of bolts 96*a* and 96*b* are screwed into weld nuts 94*a* and 94*b* and extend into clearance openings 92*a* and 92*b*, respectively.

When removal of pole 18 from ground sleeve 12 is desired, bolts 96*a* and 96*b* are rotated or tightened in weld nuts 94*a* and 94*b* causing ends 98*a* and 98*b* to abut upper surface 74 of ground sleeve flange 34. As bolts 96*a* and 96*b* continue to be tightened, pole 18 is forced apart from ground sleeve 12. In particular, lower surface 58 of pole flange 32 and the outer periphery of pole overlap section 46 are forced, as necessary, to separate from upper surface 74 of ground sleeve flange 34 and the inner periphery of ground sleeve 12.

Bolts 96*a* and 96*b* and the corresponding clearance openings 92*a* and 92*b* and weld nuts 94*a* and 94*b* are of a size, grade, and strength sufficient to create a force, upon tightening bolts 96*a* and 96*b*, that overcomes the force holding pole 18 to ground sleeve 12. For example, if a larger basketball system with a 72 inch board and 6 inch pole is to be removed, a higher grade bolt may be used. As shown, jacking devices 90 are positioned to effectively apply force to the entire interface between ground sleeve 12 and pole 18, however, a single or, in the alternative, additional jacking devices 90 and alternate dispositions of the jacking device(s) may be employed so long as they function in accordance with the invention.

Figure 13:
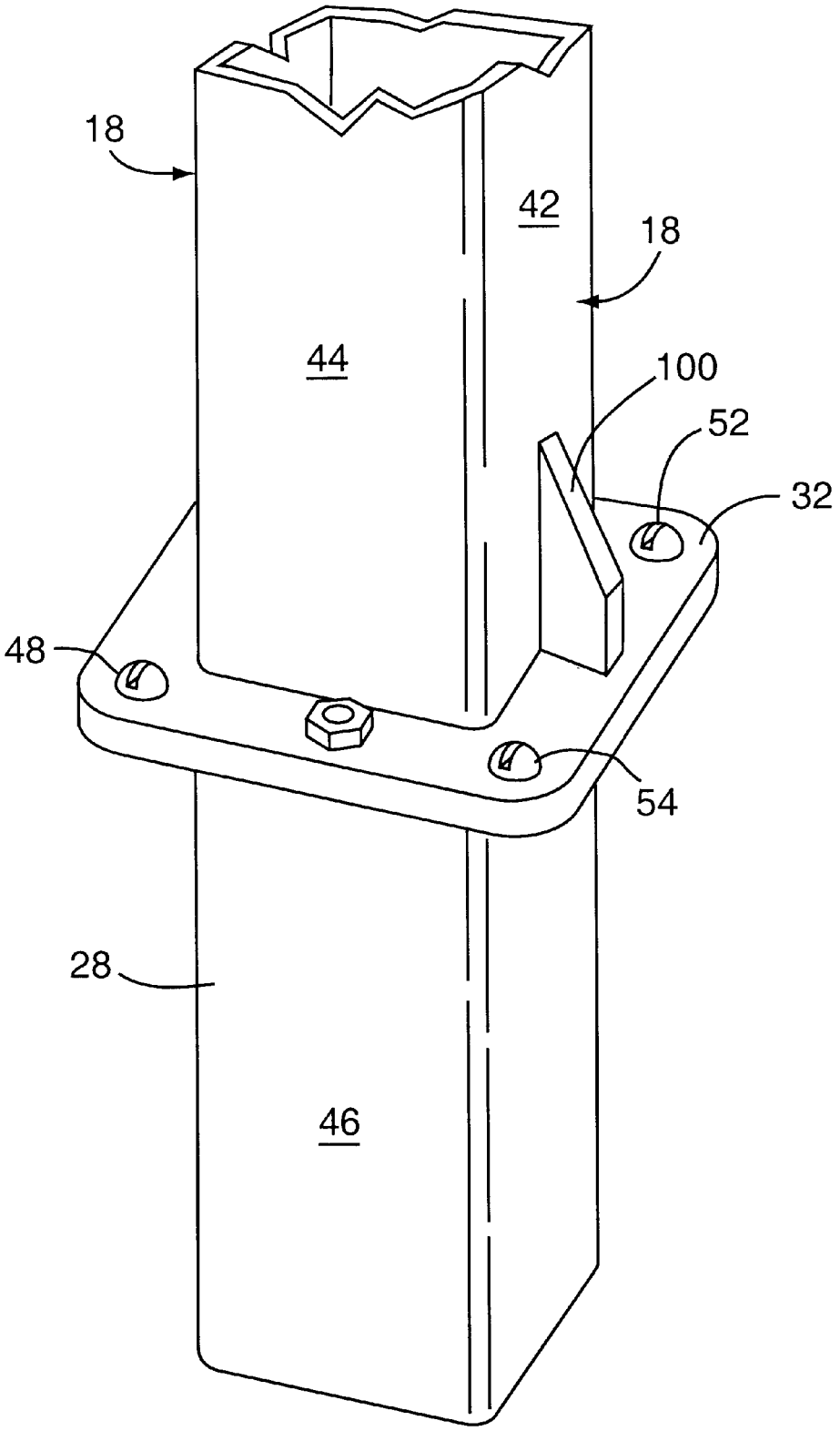
FIG. 13 is a perspective view of a second embodiment of the invention in which the bottom portion of the basketball pole includes a reinforcing web.

Referring now to FIG. 13, another embodiment of the invention including reinforcing webs is illustrated. For example, web 100 may extend between side 42 of pole 18 and upper surface 74 of pole flange 32 to reinforce the connection between flange 32 and pole 18 and to limit or prevent flange 32 from deflecting. As shown, web 100 has a substantially flat trapezoidal shape, however, other shapes and configurations are contemplated. Similar webs may be formed between ground sleeve flange 34 and main body 66 of ground sleeve 12. Any quantity of webs may be used in accordance with the invention to achieve the desired strength.

In the embodiments shown in FIGS. 14–17 the pole flange is shaped particularly to provide additional strength. Moreover, in the embodiment shown in FIGS. 17 and 18, the ground sleeve flange also is shaped to facilitate alignment of the pole into the ground sleeve during installation. Only aspects of these embodiments that differ substantially from the embodiments described previously are discussed below.

Figure 14:
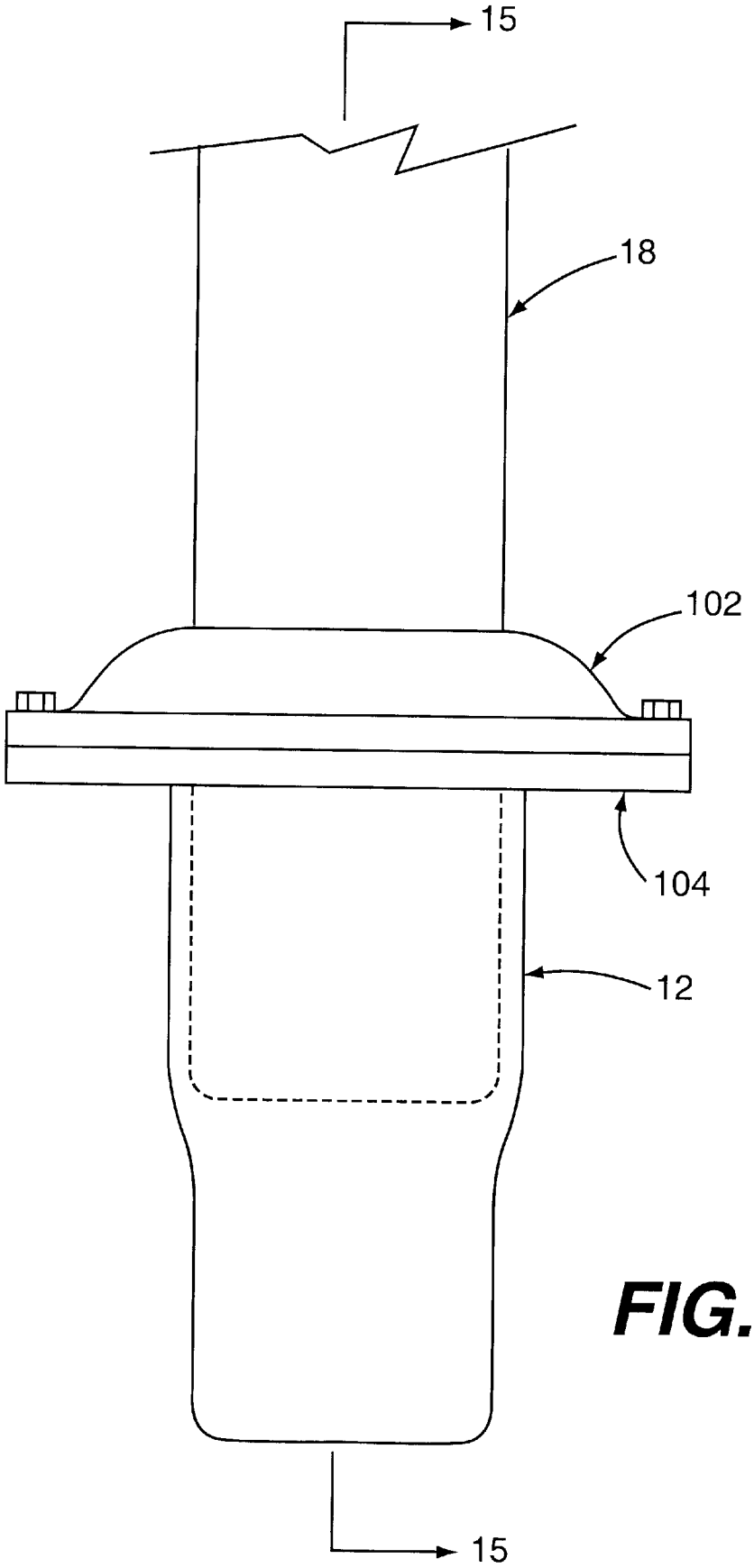
FIG. 14 is a side elevational view of a basketball pole mounting system constructed in accordance with another embodiment of the invention in which the pole has a curved mounting flange.
Figure 15:
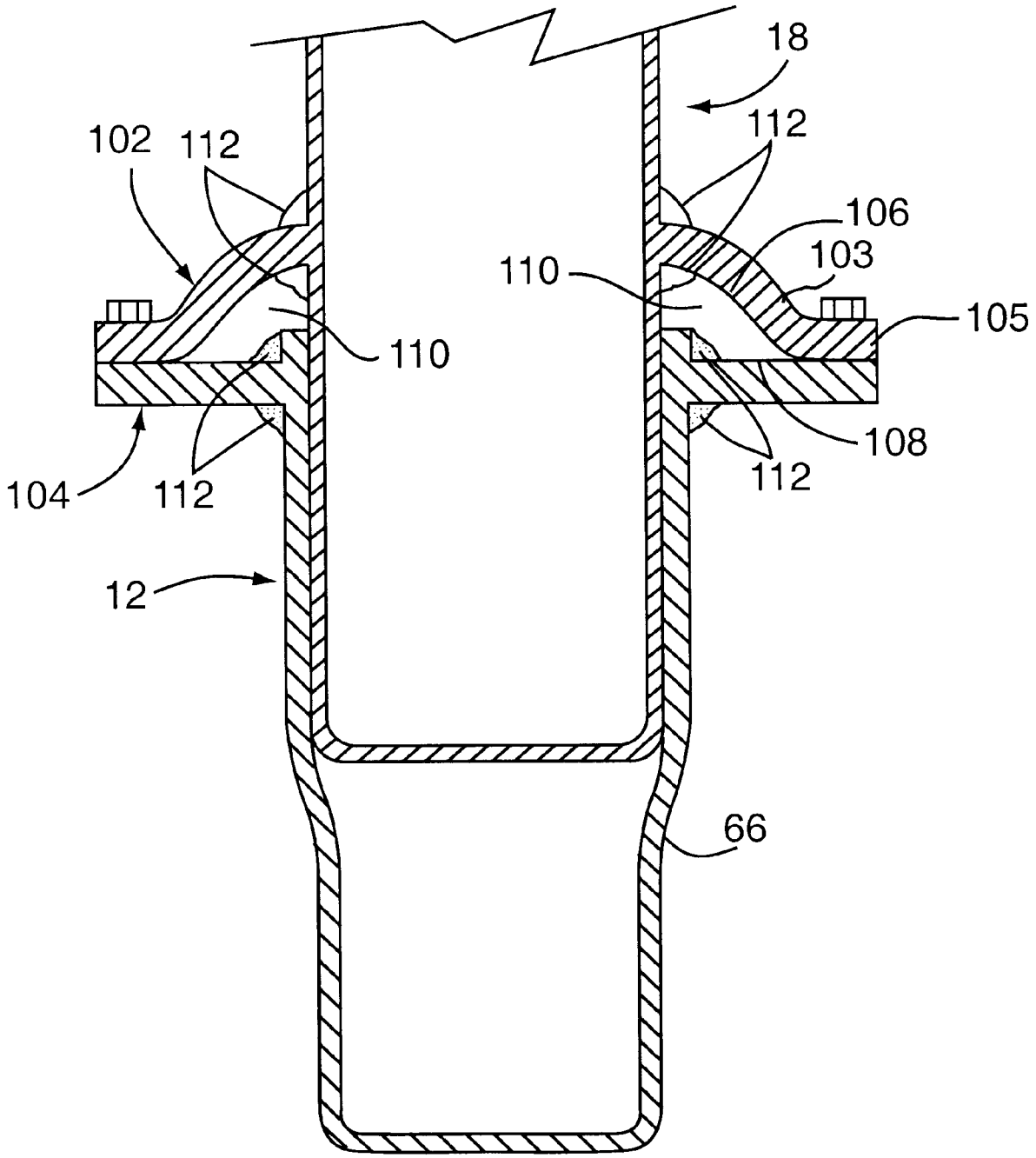
FIG. 15 is a cross-sectional view taken along line 15—15 in FIG. 14.

Referring to FIGS. 14 and 15, pole 18 has a flange 102 and ground sleeve 12 has a flange 104. In this embodiment, flange 102 is dome- or bell-shaped and includes a curved portion 103 and a flat portion 105, which is disposed substantially perpendicular to longitudinal axis 19 and is adapted for attachment to flange 104 in the manner discussed above. Flange 102 is welded on pole 18 at both upper surface 56 and lower surface 58 as shown by welds 112. The outer dimension of flange 102 as shown is 7 inches square, for example. A peripheral cavity 110 is formed between lower surface 106 of flange 102 and upper surface 108 of flange 104. Cavity 110 may have approximately a maximum 1 inch longitudinal height.

Ground sleeve flange 104 is substantially the same as ground sleeve flange 34 discussed earlier, however, it is disposed on main body 66 slightly lower, approximately 0.375 inches, than open end 63 of ground sleeve 12 such that flange 104 can be welded on pole 18 at both upper surface 74 and lower surface 76 as shown by welds 112. In this embodiment, because part of flanges 102 and 104 are separated from each other by cavity 110, flanges 102 and 104 may be welded to pole 18 and ground sleeve 12, respectively, on both their upper and lower surfaces 56, 58, 74 and 76, respectively, without interfering with the interface between flanges 102 and 104. However, as discussed with reference to the embodiment shown in FIGS. 1–12, flanges 32 and 34 can be welded to pole 18 and ground sleeve 12 only on the sides facing away from the interface while still providing the required strength to support basketball system 10. This embodiment shown in FIGS. 14 and 15 also has the inherent advantage of a reduced amount of surface contact between flanges 102 and 104, which is advantageous to the removability aspect of the invention.

Figure 16:
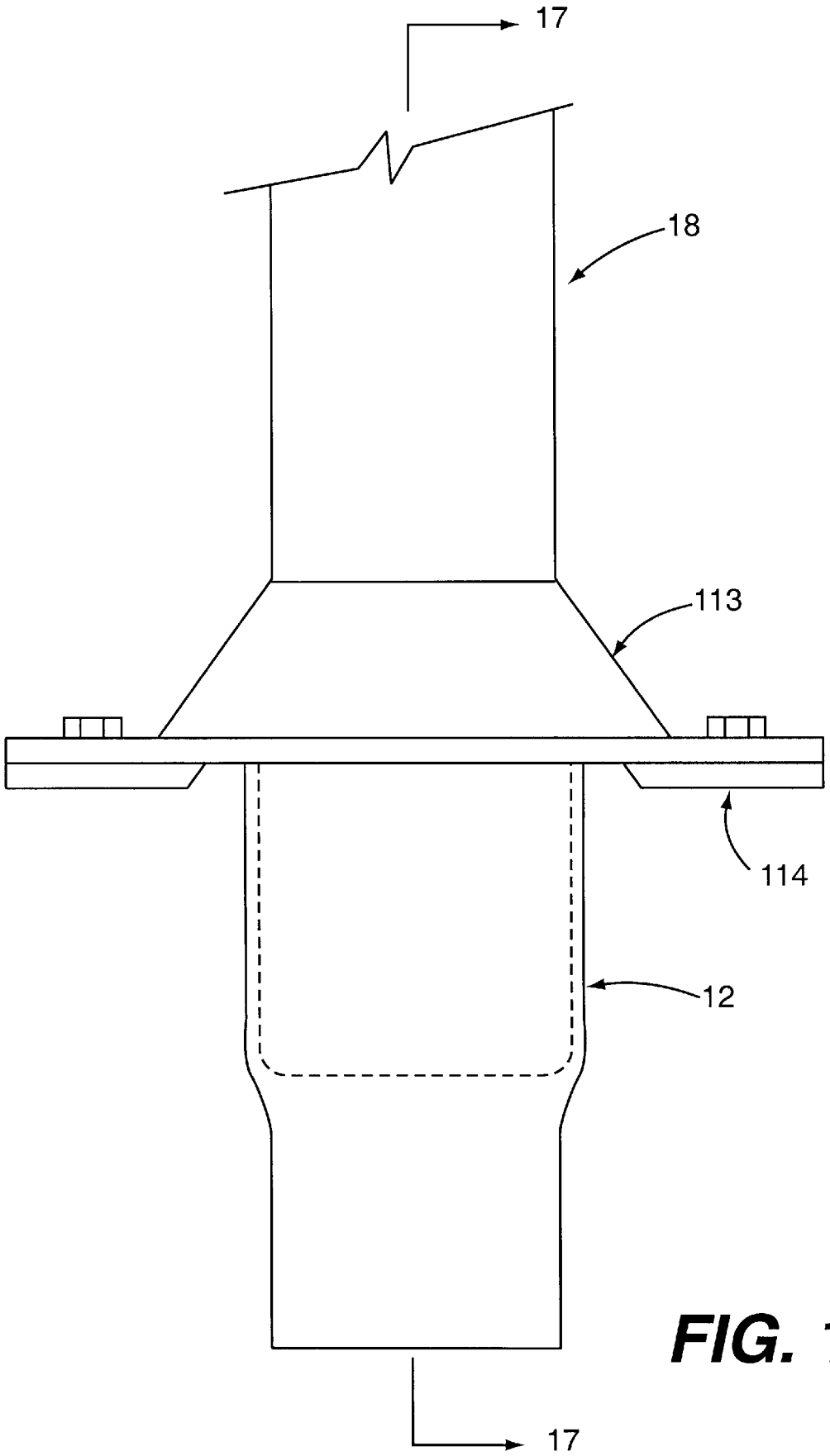
FIG. 16 is a side elevational view of a basketball pole mounting system in accordance with a further embodiment of the invention in which the ground sleeve and pole have tapered flanges.
Figure 17:
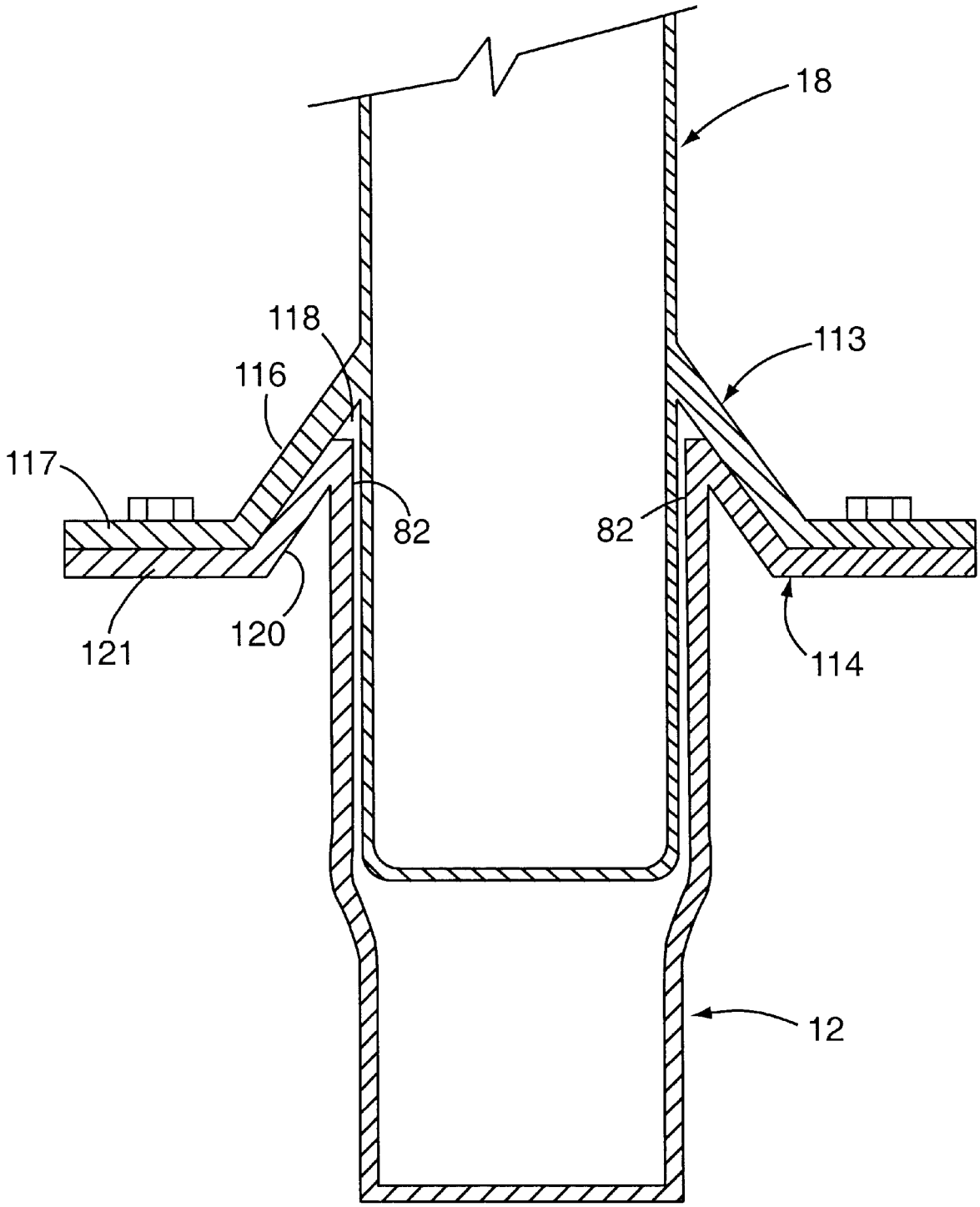
FIG. 17 is a cross-sectional view taken along line 17—17 in FIG. 16.

Referring now to FIGS. 16 and 17, an embodiment of the invention is disclosed where pole 18 includes tapered flange 113 and ground sleeve 12 includes tapered flange 114. Tapered flanges 113 and 114 are attached to pole 18 and ground sleeve 12, respectively, preferably by welding as described earlier, however, the welds are not illustrated.

More specifically, pole flange 113 has a tapered portion 116 extending outwardly toward ground sleeve 12 at an acute angle to longitudinal axis 19, however, linearly rather than curvilinearly as with flange 102. Flange 113 creates a small cavity 118 between a lower surface of flange 113 and an upper surface of flange 114 such that welds may be applied to both sides of flanges 113 and 114 so long as they do not interfere with the interface between flanges 113 and 114. Flange 113 also has a flat outer peripheral portion 117 that is disposed substantially perpendicularly to longitudinal axis 19 and is adapted for attachment to flange 114 in the manner discussed above.

Moreover, in this embodiment, ground sleeve flange 114 also has a corresponding peripheral tapered portion 120 extending from open end 63 of ground sleeve 12 at substantially the same acute angle to longitudinal axis 19 as tapered portion 116. This tapered portion 120 nests in cavity 118 of flange 113 thereby assisting in guiding and aligning pole 18 into ground sleeve 12 during installation. A flat portion 121 of flange 114 extends substantially perpendicularly to longitudinal axis 19 and is adapted for attachment to flange 112 in accordance with the invention.

Although not particularly shown in FIGS. 15–18, these embodiments of the invention may also include jacking devices 90 discussed earlier to facilitate removal of pole 18 from ground sleeve 12.

What is claimed is:

1. A mounting system for supporting an in-ground basketball system, said mounting system comprising:

a ground sleeve with an interior surface and having an opening and a first flange extending outwardly from said ground sleeve;

a basketball support pole with an exterior surface and having first and second ends, and a second flange extending outwardly from said basketball support pole intermediate said first and second ends, said basketball support pole being received within said opening of said ground sleeve such that said interior surface of said ground sleeve substantially abuts said exterior surface of said basketball support pole within said ground sleeve; and a connector coupling said first and second flanges together, said connector being disposed substantially outside of said pole.

2. A mounting system according to claim 1, wherein said second flange is disposed a predetermined distance from said first end such that said pole is received in said ground sleeve in overlapping relationship by an amount substantially equal to said predetermined distance.

3. A mounting system according to claim 2, wherein said predetermined distance is selected to be great enough such that said ground sleeve supports the pole without relying upon the function of said connector.

4. A mounting system according to claim 2, wherein said predetermined distance is approximately five inches.

5. A mounting system according to claim 1, wherein the mounting system has a longitudinal axis and at least one of said first flange and said second flange extends substantially perpendicular to said longitudinal axis.

6. A mounting system according to claim 1, wherein the mounting system has a longitudinal axis and said first flange has a first portion extending at an angle to said longitudinal axis and a second portion extending substantially perpendicular to said longitudinal axis.

7. A mounting system according to claim 6, wherein said second flange has a third portion extending at said angle to said longitudinal axis and a fourth portion extending substantially perpendicular to said longitudinal axis, and said first portion contacts said third portion and said second portion contacts said fourth portion.

8. A mounting system according to claim 6, wherein said opening in said ground sleeve is tapered to assist in guiding said pole into said ground sleeve.

9. A mounting system according to claim 1, where the mounting system has a longitudinal axis and said second flange has a curved portion and a flat portion extending from said curved portion substantially perpendicular to said longitudinal axis.

10. A mounting system according to claim 1, wherein said ground sleeve has a closed end and an open end, with said opening being defined by said open end.

11. A mounting system according to claim 1, wherein said ground sleeve has a first portion with a first transverse interior size at said opening and a second portion with a second transverse interior size smaller than said first interior size, said pole being received within said first portion.

12. A mounting system according to claim 1, wherein said connector is a removable connector such that said pole can be removed from said ground sleeve.

13. A mounting system according to claim 1, wherein said connector comprises a plurality of connectors.

14. A mounting system according to claim 13, wherein said first flange includes a first plurality of openings and said second flange includes a second plurality of openings alignable with said first plurality of openings to form a pair of openings, and each pair of openings receives one of said plurality of connectors.

15. A mounting system according to claim 14, wherein said connectors comprise threaded bolts.

16. A mounting system according to claim 1, wherein said pole and said ground sleeve each have a substantially square transverse cross-section.

17. A mounting system according to claim 1, further comprising:

a jacking member provided on at least one of said first and second flanges operable to separate said first flange from said second flange.

18. A mounting system according to claim 17, wherein said jacking member comprises a threaded opening associated with said second flange and a threaded shaft having a first end screwed into said threaded opening, such that upon rotation of said threaded shaft in a jacking direction said first end abuts said first flange causing said pole and said ground sleeve to separate.

19. A mounting system according to claim 17, wherein said pole has a first side and a second side opposing said first side and said jacking member comprises a pair of jacking members provided, one each, on said first and second sides.

20. A mounting system according to claim 1, further comprising a reinforcing web provided on at least one of said first and second flanges.

21. A method of separating a flanged basketball support pole from a flanged ground sleeve in an in-ground basketball system by providing a separation mechanism on the pole flange that is cammingly engageable with the ground sleeve flange, said method comprising the steps of:

removing any mechanical connectors used to connect the pole to the ground sleeve during installation of the pole in the ground sleeve; and operating the separation mechanism until the pole and the ground sleeve separate.

22. A method according to claim 21, wherein the step of operating the separation mechanism comprises rotating a threaded shaft threaded through an opening in the pole flange causing an end of the threaded shaft to abut and then separate the ground sleeve flange and the pole sleeve flange.

23. A method of making a flanged mounting system for supporting an in-ground basketball system, said method comprising the steps of:

a) securing a first flange to a ground sleeve having an interior surface;

b) securing a second flange to a basketball support pole having an exterior surface;

c) inserting the basketball support pole into the ground sleeve such that said interior surface of said ground sleeve substantially abuts said exterior surface of said basketball support pole; and d) securing the first and second flanges together.

24. A method according to claim 23, further comprising the steps of:

forming the ground sleeve from a stock material having a cross-section;

forming the pole from the same stock material having the same cross-section; and increasing the cross-section of one end of the stock material of the ground sleeve.

25. A method according to claim 23, wherein step (d) further comprises removably securing the first and second flanges together with removable connectors.

26. A mounting system for supporting an in-ground basketball system, said mounting system comprising:

a ground sleeve having an opening and a first flange extending outwardly from said ground sleeve;

a basketball support pole having first and second ends, and a second flange extending outwardly from said basketball support pole intermediate said first and second ends, said basketball support pole being received within said opening of said ground sleeve;

a connector coupling said first and second flanges together, said connector being disposed substantially outside of said pole; and said mounting system has a longitudinal axis and said first flange has a first portion extending at an angle to said longitudinal axis and a second portion extending substantially perpendicular to said longitudinal axis.

27. A mounting system according to claim 26, wherein said second flange has a third portion extending at said angle to said longitudinal axis and a fourth portion extending substantially perpendicular to said longitudinal axis, and said first portion contacts said third portion and said second portion contacts said fourth portion.

28. A mounting system according to claim 26, wherein said opening in said ground sleeve is tapered to assist in guiding said pole into said ground sleeve.

29. A mounting system for supporting an in-ground basketball system, said mounting system comprising:

a ground sleeve having an opening and a first flange extending outwardly from said ground sleeve;

a basketball support pole having first and second ends, and a second flange extending outwardly from said basketball support pole intermediate said first and second ends, said basketball support pole being received within said opening of said ground sleeve;

a connector coupling said first and second flanges together, said connector being disposed substantially outside of said pole;

wherein said mounting system has a longitudinal axis and said second flange has a curved portion and a flat portion extending from said curved portion substantially perpendicular to said longitudinal axis.

30. A mounting system for supporting an in-ground basketball system, said mounting system comprising:

a ground sleeve having a first portion with a first transverse interior size at an opening and a second portion with a second transverse interior size smaller than said first interior size and a first flange extending outwardly from said ground sleeve;

a basketball support pole having first and second ends, and a second flange extending outwardly from said basketball support pole intermediate said first and second ends, said basketball support t pole being received within said first portion of said ground sleeve;

a connector coupling said first and second flanges together, said connector being disposed substantially outside of said pole.

31. A mounting system for supporting an in-ground basketball system, said mounting system comprising:

a ground sleeve having an opening and a first flange extending outwardly from said ground sleeve;

a basketball support pole having first and second ends, and a second flange extending outwardly from said basketball support pole intermediate said first and second ends, said basketball support pole being received within said opening of said ground sleeve;

a connector coupling said first and second flanges together, said connector being disposed substantially outside of said pole; and a jacking member provided on at least one of said first and second flanges operable to separate said first flange from said second flange.

32. A mounting system according to claim 31, wherein said jacking member comprises a threaded opening associated with said second flange and a threaded shaft having a first end screwed into said threaded opening, such that upon rotation of said threaded shaft in a jacking direction said first end abuts said first flange causing said pole and said ground sleeve to separate.

33. A mounting system according to claim 31, wherein said pole has a first side and a second side opposing said first side and said jacking member comprises a pair of jacking members provided, one each, on said first and second sides.

34. A ground sleeve for supporting a basketball support pole and a basketball goal assembly, said ground sleeve comprising:

a tubular body having a first portion with a first transverse interior size configured to receive the portion of the basketball support pole and a second portion having a second transverse interior size smaller than said first transverse interior size; and a flange extending outwardly from said tubular body, said flange having a first side configured to be disposed in a vicinity of the ground and a second side opposing said first side configured to contact a complementary flange on a basketball support pole.

35. A ground sleeve for supporting a basketball support pole and a basketball goal assembly, said ground sleeve comprising:

a tubular body configured to receive a portion of a basketball support pole;

a flange extending outwardly from said tubular body, said flange having a first side configured to be disposed in a vicinity of the ground and a second side opposing said first side configured to contact a complementary flange on a basketball support pole; and said ground sleeve has a longitudinal axis and said flange has a first portion extending at an angle to said longitudinal axis and a second portion extending substantially perpendicular to said longitudinal axis.

36. A ground sleeve for supporting a basketball support pole and a basketball goal assembly, said ground sleeve comprising:

a tubular body configured to receive a portion of a basketball support pole; and a flange extending outwardly from said tubular body provided with a jacking member thereon, said flange having a first side configured to be disposed in a vicinity of the ground and a second side opposing said first side configured to contact a complementary flange on a basketball support pole.

37. A method of making a flanged mounting system for supporting an in-ground basketball system, said method comprising the steps of:

a) securing a first flange to a ground sleeve formed from a stock material having a width;

b) securing a second flange to a basketball support pole formed from the same stock material having the same width;

c) increasing the width of one end of the stock material of the ground sleeve;

d) inserting the basketball support pole into the ground sleeve; and e) securing the first and second flanges together.

38. A ground sleeve for supporting a basketball support pole and a basketball goal assembly, said ground sleeve comprising:

an interior surface;

a tubular body configured to receive a portion of a basketball support pole having an exterior surface therein, said tubular body having a first portion with a first transverse interior size configured to receive the portion of the basketball support pole and a second portion having a second transverse interior size smaller than said first transverse interior size; and a flange extending outwardly from said tubular body, said flange having a first side configured to be disposed in a vicinity of the ground and a second side opposing said first side configured to contact a complementary flange on a basketball support pole, such that said interior surface of said ground sleeve substantially abuts said exterior surface of said basketball support pole.

39. A ground sleeve for supporting a basketball support pole and a basketball goal assembly, said ground sleeve comprising:

an interior surface;

a longitudinal axis;

a tubular body configured to receive a portion of a basketball support pole having an exterior surface therein; and a flange extending outwardly from said tubular body, said flange having a first side configured to be disposed in a vicinity of the ground and a second side opposing said first side configured to contact a complementary flange on a basketball support pole, such that said interior surface of said ground sleeve substantially abuts said exterior surface of said basketball support pole, said a first angle to said longitudinal axis and a second portion extending substantially perpendicular to said longitudinal axis.

40. A ground sleeve for supporting a basketball support pole and a basketball goal assembly, said ground sleeve comprising:

an interior surface a tubular body configured to receive a portion of a basketball support pole having an exterior surface therein;

a flange extending outwardly from said tubular body, said flange having a first side configured to be disposed in a vicinity of the ground and a second side opposing said first side configured to contact a complementary flange on a basketball support pole, such that said interior surface of said ground sleeve substantially abuts said exterior surface of said basketball support pole; and a jacking member provided on said flange.

* * * * *